US005692253A

United States Patent [19]

Keijser et al.

[11] Patent Number: 5,692,253

[45] Date of Patent: Dec. 2, 1997

[54] HOIST FOR LIFTING A PATIENT

[75] Inventors: Johannes Wilhelmus M. Keijser, Helmond; Jan Abraham Ridder, Eindhoven, both of Netherlands

[73] Assignee: Mocare B.V., Amersfoort, Netherlands

[21] Appl. No.: 740,658

[22] Filed: Oct. 31, 1996

[30] Foreign Application Priority Data

Oct. 31, 1995 [NL] Netherlands ..... 1001538

[51] Int. Cl.[6] ..... A61G 7/10

[52] U.S. Cl. ..... 5/83.1; 5/87.1

[58] Field of Search ..... 5/81.1 R, 83.1, 5/86.1, 87.1, 89.1

[56] References Cited

U.S. PATENT DOCUMENTS

| | | | |
|---|---|---|---|
| 2,650,725 | 9/1953 | Hoyer et al. | 5/87.1 X |
| 3,694,829 | 10/1972 | Bakker | 5/81 |
| 3,940,808 | 3/1976 | Petrini | 5/83.1 |
| 4,409,696 | 10/1983 | Bakker | 5/87.1 |
| 5,365,621 | 11/1994 | Blain | 5/87.1 |

FOREIGN PATENT DOCUMENTS

| | | | |
|---|---|---|---|
| 2 184 706 | 7/1987 | United Kingdom | A61G 7/10 |
| 2 272 679 | 5/1994 | United Kingdom | A61G 7/14 |

*Primary Examiner*—Michael F. Trettel
*Attorney, Agent, or Firm*—Deveau, Colton & Marquis

[57] ABSTRACT

Lifting yoke for a patient lifting apparatus, in which the lifting yoke is suspended rotatably about a vertical axis from a lifting arm which is movable up and down relative to the frame. The lifting yoke includes:

a bearing arm which is suspended rotatably relative to the lifting arm;

a first and a second rod, which at one end can each be swivelled separately relative to the bearing arm, and at the other end bear the strap(s) for supporting the patient, and a drive mechanism which acts upon the bearing arm and upon one of the rods, in order to make the rods swivel relative to each other between a position corresponding to the reclining position of the patient and a position corresponding to the sitting position of the patient.

12 Claims, 4 Drawing Sheets

HOIST FOR LIFTING A PATIENT

BACKGROUND OF THE INVENTION

The invention relates to a lifting yoke for a patient lifting apparatus, for supporting the patient by means of one or more straps to be placed under the patient's body, and for transferring the patient from the reclining position to the sitting position, in which the lifting yoke is suspended, rotatably about a vertical axis, from a lifting arm which is movable up and down relative to the frame.

Patient lifting appliances, often called patient hoists, can be equipped with various aids for carrying a patient, and for lifting and moving the patient, partly in an active state, and sometimes also in a passive state. One of those aids is a lifting yoke, by means of which the patient can be moved from a reclining position to a sitting position. The common feature in most well-known types of lifting yoke is that they are made of a single rigid rod, which is generally substantially U-shaped or V-shaped in top view, and can be swung about a horizontal axis relative to a bracket which provides for the rotatability of lifting yoke and patient about a vertical axis. The movement of the yoke between the position corresponding to the reclining position of the patient and the position corresponding to the sitting position of the patient is usually obtained by hand, using a handle which is provided on said bracket, in the region above the patient and between the patient's knees.

Although the patient is hanging more or less balanced relative to the horizontal swivel axis for the bracket, during the movement the centre of gravity always shifts to such an extent that considerable force must be exerted by hand. Means must also be provided for producing friction or fixing near the swivel point, so that a position is retained once it is set, even if at that moment the position of the centre of gravity of the patient being carried would cause a turning moment.

OBJECTS OF THE INVENTION

The general object of the invention is to propose an improvement by which the indicated problem can be avoided. More particularly it is an object to provide a lifting yoke which has an electric drive for the change of position. A further object is to provide an built in blocking mechanism for preventing accidental movement of the yoke from its position once it has been set.

SUMMARY OF THE INVENTION

These objects are realized by a lifting yoke which further comprises:

- a bearing arm which is suspended rotatably relative to the lifting arm;
- a first and a second rod, which at one end can each be swivelled separately relative to the bearing arm, and at the other end bear the strap(s) for supporting the patient and
- a drive which acts upon the bearing arm and upon one of the rods, in order to make the rods swivel relative to each other between a position corresponding to the reclining position of the patient and a position corresponding to the sitting position of the patient.

In the basic idea the lifting yoke therefore is a system of swivelling rods, suspended from a bearing arm, and designed in such a way that a drive can be fitted. Said drive can be in the form of a linear actuator.

This basic idea can be achieved in various ways. It is preferably designed in such a way that:

- the first rod in side view is extended;
- the second rod has its centre of rotation higher up than the centre of rotation of the first rod;
- the second rod crosses the first rod and in side view is bent and
- in particular at the place where the two rods cross, a means which limits the possibility for mutual movement of the rods is present, the means for limiting the possibility for mutual movement of the rods preferably being formed by a roller support which is fitted on the second rod, and on which the first rod rests and rides.

In this way, the greatest efficiency is achieved from the point of view of exerting force by the drive, combined with a movement path of the suspension points on the rods, i.e. of the sling in which the patient is hanging or sitting, which is such that this movement is not experienced by the patient as being unpleasant.

SUMMARY OF THE DRAWINGS

FIGS. 3 and 4 show other positions of the same lifting yoke, corresponding to an intermediate position and a sitting position respectively of the patient.

DETAILED DESCRIPTION

Figure 1:
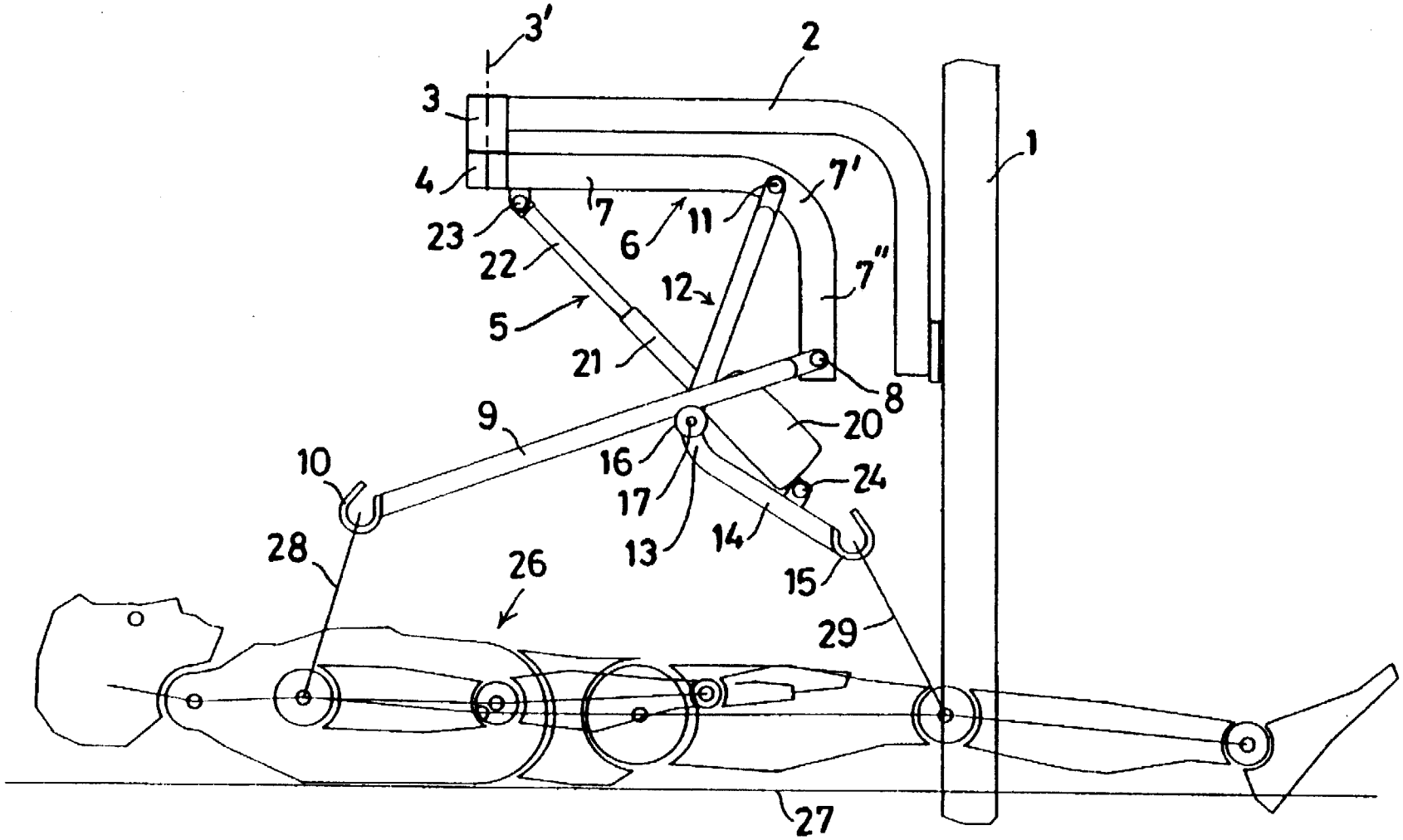
FIG. 1 of the appended drawings shows diagrammatically, in form of a side view of an exemplary embodiment, the lifting yoke according to the invention, suspended from the bearing arm, which is in turn suspended from the lifting arm which is movable up and down relative to the frame; in this figure the lifting yoke is shown in the position corresponding to the stretched-out, reclining position of the patient.

FIG. 1 represents diagrammatically at 1 a part of a frame of the patient hoist. A lifting arm 2 is fitted, in a manner which is known per se, so that it is movable vertically relative to the frame, in order to be able to take up, set down or lay down the patient at various height positions.

A pivoted coupling 3 with vertical axis is fitted at the end of the lifting arm 2 facing away from the frame 1, from which pivoted coupling the lifting yoke is suspended in a manner known per se by an associated coupling part 4, in a manner which forms, preferably, a rapid coupling which is also known per se. The lifting yoke according to the invention is indicated in its entirety by 5. The yoke 5 can be swivelled in its entirety about the vertical axis 3' of the coupling 3, 4.

The lifting yoke 5 comprises a bearing arm 6, in this embodiment formed by a piece 7 extending horizontally, and a piece 7" extending vertically when the apparatus is in use, said pieces being connected by a curved transition part 7'.

A first rod 9 is provided in such a way that it can swivel about a horizontal swivel axis 8 near the bottom end of the bearing arm 6, the other end thereof bearing a hook 10 from which a carrying strap, which is known per se, and which is placed under the patient's body, can be suspended.

In the curved part 7' of bearing arm 6 a second rod, indicated in its entirety by 12, can swivel about a likewise horizontal axis 11. Swivel axis 11 is thus situated i ted higher up than 8. The second rod 12 in side view is bent and has a rounded transition 13, so that the bottom part 14 points downwards in the direction away from the hook 10. Another hook 15 is provided at the end of the second rod 12, for attaching a patient carrying strap.

This means that the first rod 9 and the second rod 12 cross each other. Near the transition part 13, a roller 16 is fitted on the second rod, which roller is rotatable relative to a swivel point 17 on the second rod. The first rod 9 rests on said roller 16, during use in particular under the influence of the part of the weight of the patient hanging from hook 10.

Figure 2:
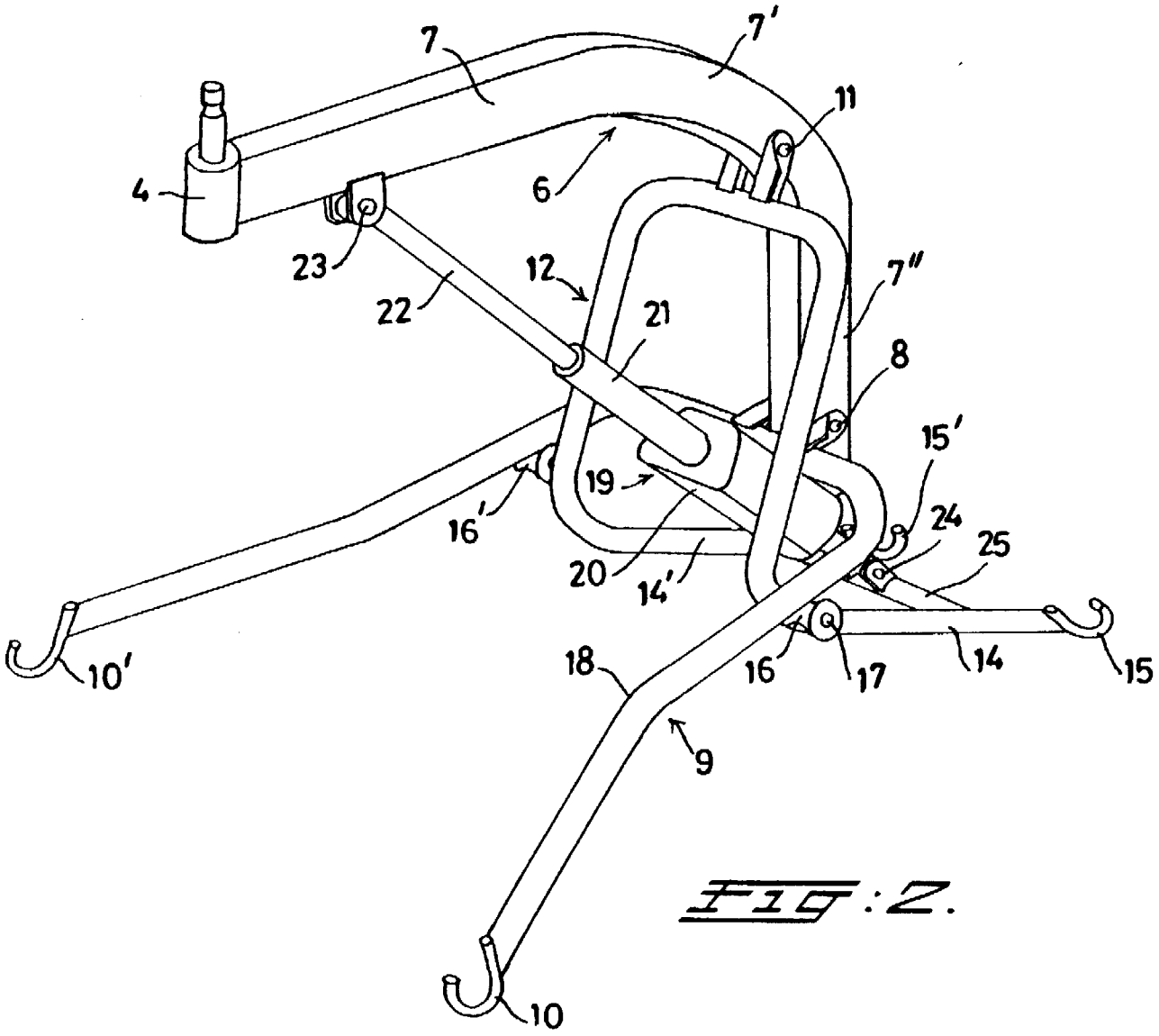
FIG. 2 shows diagrammatically in perspective the lifting yoke of FIG. 1 with the bearing arm.
Figure 5:
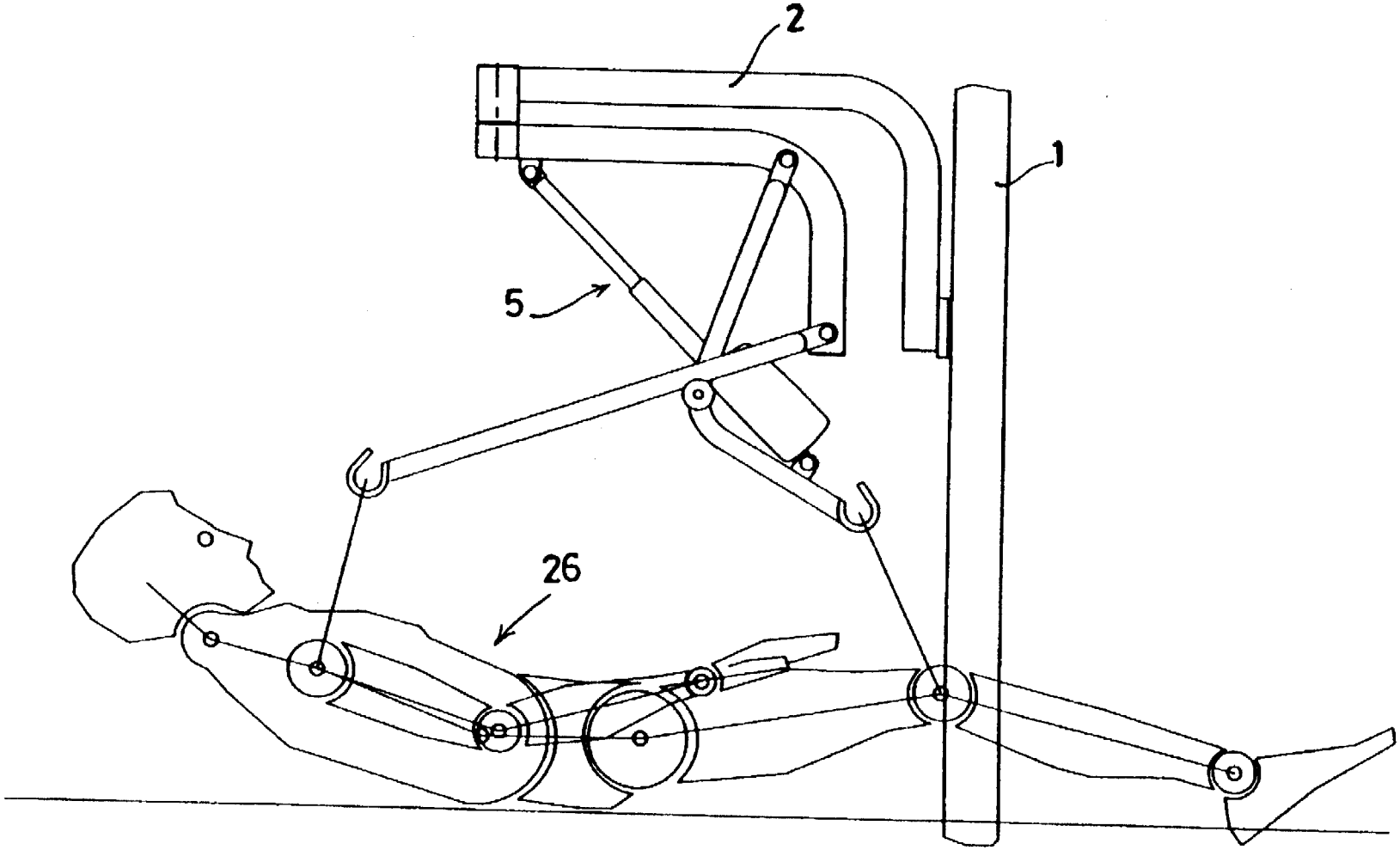

Before the drive and the operation of the rod system of the lifting yoke are described, reference is made to FIG. 2. It can be seen from this figure that the rod 9 is substantially U-shaped, and in top view has a slight bend in each of the two legs of the U-shape, indicated by 18, so that the two suspension hooks 10 and 10' go at an adequate distance from each other to suit the shoulder width of the patient to be carried. The second rod 12 can also be described as substantially U-shaped—imagined before the bend 13 has been made—so that two hooks 15 and 15' respectively are also fitted at the ends for carrying the strap. The external width of the second rod 12 is slightly smaller than the internal width of the first arm 9, so that the former is situated inside the shape of the latter. Of course, apart from the roller 16 at one side, a corresponding roller 16' is fitted at the other side, so that both legs of rod 9 are supported on rollers.

The drive which determines the mutual position of the two arms is present as a single drive, lying substantially in the plane of symmetry, which is also the plane through the bearing arm 6. The drive, indicated in its entirety by 19, is formed by a linear actuator 20 (an electric motor with built-in screw spindle transmission). Rod 21 forms part of the housing of "motor" 20, which can press telescopic rod 22 outwards. The end of rod 22 is fitted on the horizontal part 7 of the bearing arm 6 in such a way that it can swivel about an axis 23. The bottom end of the motor 20 is fixed in such a way that it can swivel about a swivel axis 24 relative to a rod 25 between the two legs of the U-shape of the bottom parts 14, 14' of the second rod 12.

The mutual position of the rods and the drive of the lifting yoke is the same in FIG. 2 as in FIG. 1. Reverting to FIG. 1, a patient 26 in a reclining position on e.g. a bed 27 is shown diagrammatically, with an indication of the main joints which determine the position of the patient. Lines 28 and 29 between the hooks 10 and 15 respectively, on the one hand, and the shoulder zone and the knee zone respectively of the patient, on the other hand, symbolize the direction of the forces which are exerted by the patient on the hooks 10, 15, and which are absorbed by loops by means of which the sling used for carrying the patient is suspended from the lifting yoke.

FIG. 3 shows an intermediate position of the patient, which position is reached by only moving the lifting arm 2 upwards relative to the frame 1, i.e. without changing the position of the parts of the lifting yoke 5. Simply lifting up the patient on the lifting yoke in its initial position like this means that the patient's weight gradually shifts until the patient is hanging on the straps, and therefore on the hooks. Illustrated in the drawing is the position in which the upper part of the patient's body has come forward slightly and the knees are slightly bent, while the patient is still just touching the initial lying surface.

Figure 4:
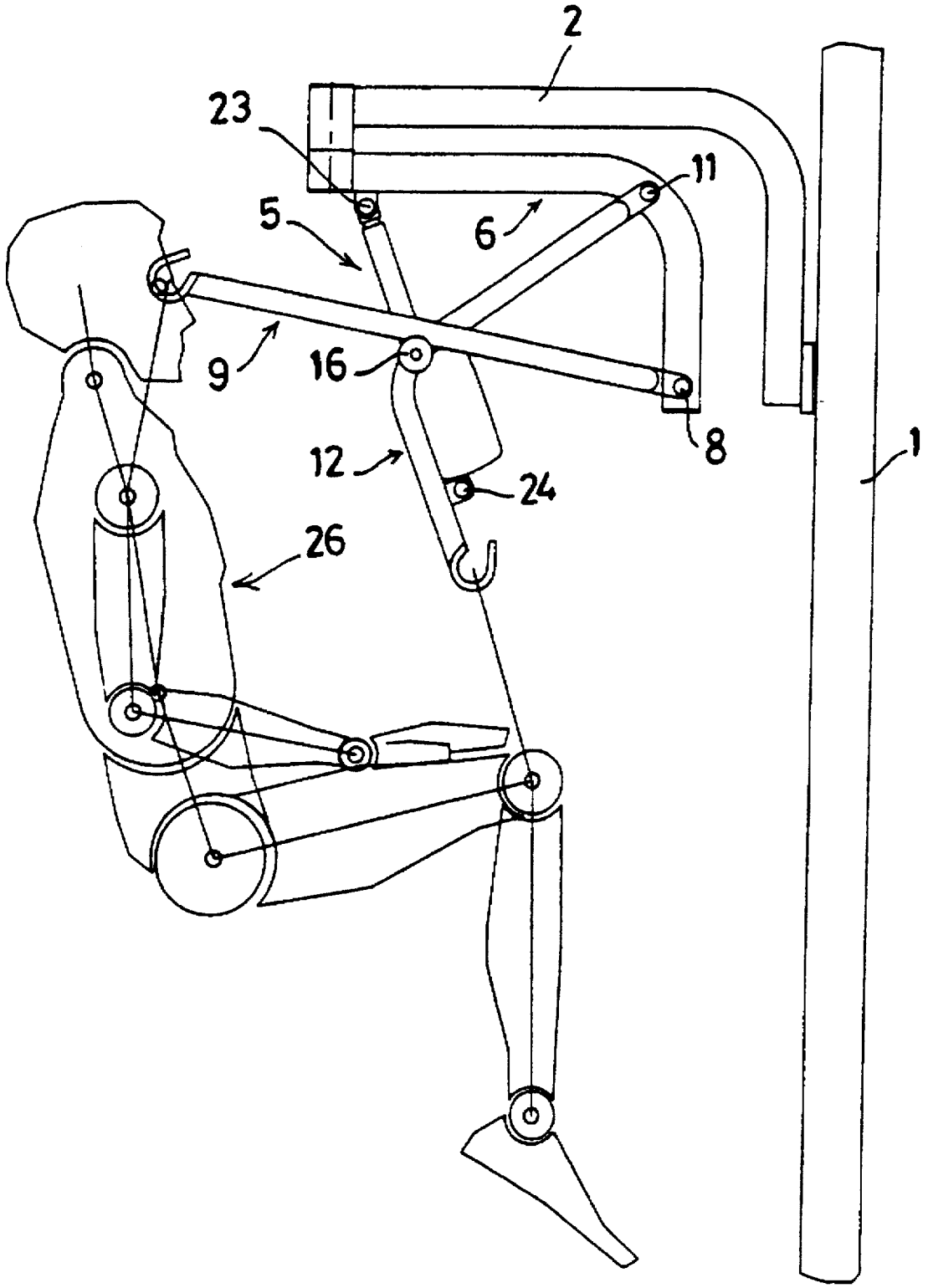

FIG. 4 shows the sitting position of the patient 26 in the carrying straps. This position is achieved, on the one hand, by producing a change in the position of the elements of the lifting yoke 5 and, on the other hand, of course, in order to allow the patient to assume a sitting position, by also setting the lifting arm 2 at a level relative to the frame 1 which is sufficiently higher up to ensure that the lower legs of the patient can hang down freely, or by moving the frame 1 so far away, after the patient has come away from the initial lying surface 27 on the bed, that the patient can reach the sitting position beside the bed.

The change of position of the elements of the lifting yoke 5 is achieved by retracting the telescopic part 22 in the linear actuator 20, 21. This shortens the distance between the action points of the drive, which means, on the one hand, swivel axis 23 relative to bearing arm 6 and, on the other hand, 24 relative to the second rod 12. The result of this in the first instance is a swivelling movement of the second rod 12 about the swivel axis 11. Due to the fact that the first rod 9 is resting on rollers 16, the first rod 9 is also lifted up, swivelling about swivel point 8, while the rotatability of rollers 16, 16' permits an extension of the distance of the support point on the rollers relative to the swivel axis 8 by means of which rod 9 is fixed relative to bearing arm 6.

The patient is returned from the sitting position to the reclining position when the drive 19 is extended again, so that the movement described takes place in reverse.

Instead of the linear actuator 20, 21 preferably used, it is, of course, also possible to use another drive for the lifting yoke according to the invention, for example a hydraulic drive, to replace manual power during operation.

We claim:

1. A patient hoist, for supporting a patient by means of at least one strap to be placed under the patient, and for transferring the patient from a reclining position to a sitting position, said patient hoist comprising:

(a) a frame;

(b) a lifting arm connected to said frame and movable up and down relative to said frame;

(c) a bearing arm rotatably coupled to the lifting arm;

(d) a first rod, having a first end pivotally connected to the bearing arm, and a second end connected to said at least one strap for supporting the patient;

(e) a second rod having a first end pivotally connected to the bearing arm, and a second end connected to said at least one strap; and (f) drive means which acts upon the bearing arm and upon one of the rods, in order to make said first and second rods swivel relative to each other between a first configuration corresponding to the reclining position of the patent and a second configuration corresponding to the sitting position of the patient.

2. A patient hoist according to claim 1, wherein said first rod is generally elongate in side view, said second rod is pivotally connected to the bearing arm at a position generally vertically above the pivotal connection between said bearing arm and the first rod, and wherein said patient hoist further comprises means for limiting the mutual movement of the rods to a combined translatory and rotary movement.

3. A patient hoist according to claim 1, wherein said first rod is generally elongate in side view, said second rod is pivotally connected to the bearing arm at a position generally vertically above the pivotal connection between said bearing arm and the first rod, the second rod further comprising at least one roller support, and wherein a portion of said first rod rests and tides on said at least one roller support.

4. A patient hoist according to claim 1, wherein the drive means has a first end pivotally mounted to the bearing arm, and a second end pivotally mounted to the second rod.

5. A patient lifting apparatus for supporting a patient by means of at least one strap to be placed under the patient's body, and for transferring the patient from a reclining position to a sitting position, the lifting apparatus comprising:

(a) a frame;

(b) a lifting arm which is movable up and down relative to said frame;

(c) a bearing arm which is suspended rotatably relative to the lifting arm about a vertical axis;

(d) a first and second rod, each of which can at one end be swiveled separately relative to the bearing arm, and each of which at the other end bear the at least one strap for supporting the patient, (i) said first rod being generally U-shaped;

(ii) said second rod being pivotally connected to said bearing arm generally vertically above the pivotal connection between said bearing arm and the first rod;

(iii) the second rod further comprising a roller support wherein a portion of said first rod rests and rides; and (e) drive means having a first end pivotally mounted to the bearing arm, and a second end pivotally mounted to the second rod, said drive means being operative to cause the rod to swivel relative to each other between a first configuration corresponding to the reclining position of the patient and a second configuration corresponding to the sitting position of the patient.

6. A patient hoist according to claim 1, wherein said first rod is generally U-shaped.

7. A lifting yoke for supporting a patient and transferring the patient between a reclining position and a sitting position, said lifting yoke for use in connection with a frame assembly, said lifting yoke comprising:

(a) a bearing arm comprising pivotal coupling means having a vertical axis of rotation for connecting said bearing arm to the frame assembly, said bearing arm further comprising a generally horizontal upper portion, a generally vertical lower portion and a transition portion between said upper and lower portions;

(b) a generally U-shaped first rod comprising two legs connected at first ends by a crosspiece, said crosspiece being pivotally connected to said lower portion of said bearing arm, said legs having second ends connected to at least one strap for carrying the patient;

(c) a second rod having a first portion pivotally connected to said bearing arm and a second portion connected to said at least one strap;

(d) means for slideably coupling said first rod and said second rod; and (e) drive means connected to said bearing arm for moving said first and second rods between a first configuration corresponding to the reclining position of the patient and a second configuration corresponding to the sitting position of the patient.

8. The lifting yoke of claim 7 wherein said first portion of said second rod comprises a generally U-shaped portion having a crosspiece pivotally connected to said bearing arm and two legs extending therefrom, said legs further comprising bottom parts angularly offset by transition portions.

9. The lifting yoke of claim 8 wherein said means for slideably coupling said first rod and said second rod comprises rollers rotatably mounted to said second rod adjacent said transition portions, the legs of said first rod resting on said rollers and sliding rollably thereon as said first and second rods move between said first configuration and said second configuration.

10. The lifting yoke of claim 9 wherein said drive means has a first end pivotally connected to said bearing arm and a second end pivotally connected to a cross bar connecting said legs of said second rod.

11. The lifting yoke of claim 7 wherein said drive means comprises a linear actuator.

12. The lifting yoke of claim 7 wherein said drive means comprises a hydraulic drive.

* * * * *